US005924303A

United States Patent [19]

Hodosh

[11] Patent Number: 5,924,303

[45] Date of Patent: Jul. 20, 1999

[54] INSULATED SOFT-SIDED PORTABLE CASE HAVING EXTERNALLY ACCESSIBLE RECEPTACLE

[75] Inventor: Marc A. Hodosh, Brookline, Mass.

[73] Assignee: California Innovations Inc., Ontario, Canada

[21] Appl. No.: 09/036,566

[22] Filed: Mar. 9, 1998

[51] Int. Cl.[6] ..... F25D 3/08

[52] U.S. Cl. ..... 62/457.4; 62/457.7; 62/457.5; 220/592.17

[58] Field of Search ..... 62/457.2, 457.4, 62/457.5, 457.7, 458, 371, 530; 220/592.01, 592.16, 592.17, 903

[56] References Cited

U.S. PATENT DOCUMENTS

| | | | |
|---|---|---|---|
| 4,655,052 | 4/1987 | Garcia | 62/441 |
| 4,916,923 | 4/1990 | Adams et al. | 62/457.1 |
| 5,050,399 | 9/1991 | Peahl | 62/244 |
| 5,095,718 | 3/1992 | Ormond et al. | 62/457.5 |
| 5,718,124 | 2/1998 | Senecal | 62/457.6 |
| 5,842,571 | 12/1998 | Rausch | 206/549 |

FOREIGN PATENT DOCUMENTS

| | | | |
|---|---|---|---|
| 2025593 | 1/1980 | United Kingdom | 62/457.5 |

*Primary Examiner*—William Doerrler
*Attorney, Agent, or Firm*—Lockwood, Alex, Fitzgibbon & Cummings

[57] ABSTRACT

A portable insulated case is provided which has insulative properties and which can function as a so-called cooler in order to help maintain a temperature within the container which is lower than room temperature. Such devices can also be used for maintaining a warmed environment. The top panel of the case has at least one receptacle or pocket depending from it and into the container. This receptacle closely holds a can, bottle or the like. The case thus functions as a holder for an open drink can, for example, while also having an externally accessible receptacle which assists in keeping it cool or warm as the case may be.

28 Claims, 2 Drawing Sheets

INSULATED SOFT-SIDED PORTABLE CASE HAVING EXTERNALLY ACCESSIBLE RECEPTACLE

BACKGROUND OF THE INVENTION

This invention generally relates to portable insulated cases which are of the soft-sided variety. More particularly, the portable insulated case is especially well suited for temporarily storing containerized drinks as well as foods, particularly those which are most advantageously stored under chilled conditions at a temperature lower than ambient temperature. The top panel of the case has at least one opening therethrough. Each such opening accommodates a downwardly depending receptacle which is accessible from outside of the portable insulated case.

Insulated containers which are easily transportable are well-known and intended for use for a variety of purposes. Included are containers which are designed for temporary storage of food and drink products for use in connection with personal travel, day trips, outings, and other similar activities where a drink or meal supply needs to be kept cool or warm for several hours.

Cases or containers in this regard include soft-walled coolers. In a typical cooler, a low temperature sink is provided, such as by ice cubes or so-called ice bricks positioned within the cooler in order to assist in maintaining a lower temperature within the cooler than is typically present outside of the cooler. Outside or ambient temperatures include room temperature and higher temperatures which can be encountered during summer months, for example. Typically, these types of coolers function solely as a vehicle for storage of drink and food products within the enclosure volume provided within the walls of the cooler. Once the item to be consumed is removed from the inside volume of the cooler, the cooler ceases to have any designed function in connection with the items to be consumed. For example, once the item to be consumed is removed from the container, it is no longer influenced by the cooling function provided by the cooler.

An important recognition attendant to the present invention is that advantages can be gained by creating a situation where the cooler can continue to provide the opportunity for positive interaction between the cooler and a food item such as a containerized drink after it has been removed from the cooler.

SUMMARY OF THE INVENTION

An insulated soft-sided portable case having one or more externally accessible receptacles is provided. A plurality of panels define an insulated enclosure which retards heat transfer and which is adapted to receive cold drinks and foods and cooling sources such as ice cubes, cooling bricks, and the like. A top panel of the portable insulated container has at least one opening therethrough, and a receptacle is positioned with respect to the opening so that the receptacle is accessible from the outside of the portable insulated case; that is, the user can place an item such as a containerized cold drink within the receptacle without having to open the portable insulated case. This externally accessible receptacle is thus adapted to function as a holder for the containerized drink and the like. It also projects well into the enclosed volume of the container. As such, the portable insulated case functions as a convenient and secure location for holding an opened drink without spilling it, while at the same time keeping a cold containerized drink cool.

It is accordingly a general object of the present invention to provide an improved portable soft-sided insulated case.

Another object of this invention is to provide an improved insulated portable case which provides means for supporting and holding an opened drink without having to open the portable insulated case in order to gain access to the opened drink.

Another object of the present invention is to provide an improved soft-sided portable insulated case for maintaining the temperature of food and/or drink items, whether above or below room temperature, while they are within the case and for providing a holder location for one or more of these items at a location which is externally accessible without requiring opening of the container and attendant disruption of the insulated properties of the case when it is fully closed.

Another object of the present invention is to provide an improved soft-sided portable insulated case having at least one externally accessible receptacle or pocket which assists in maintaining a cool temperature of a chilled containerized drink, such as a canned soft drink.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 2:
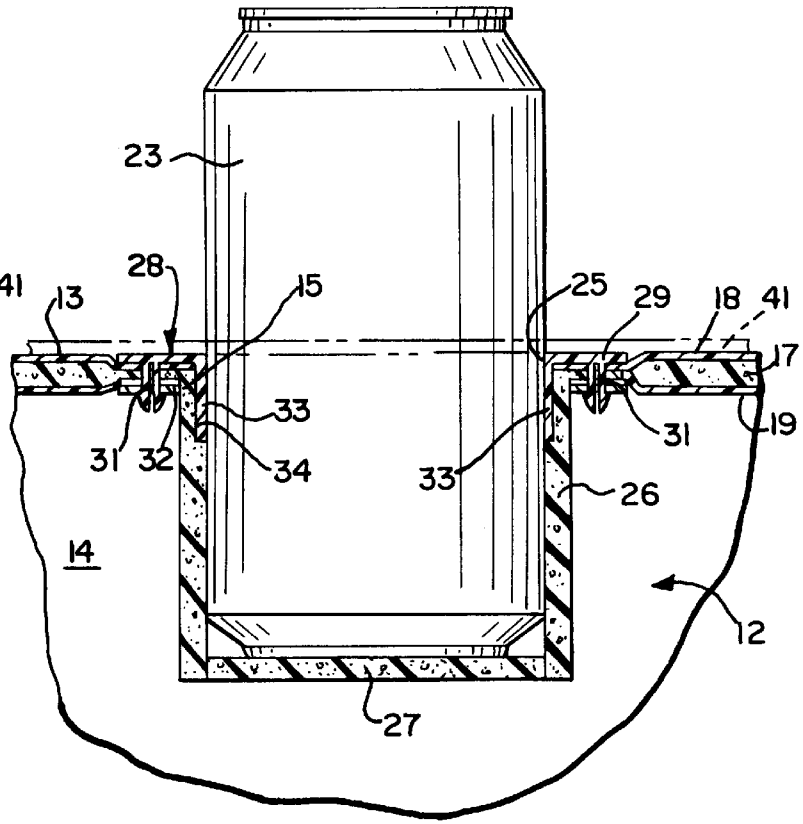
FIG. 2 is a detailed, cut-away generally cross-sectional view illustrating an embodiment of the externally accessible receptacle, shown with a can of soda positioned therewithin.

A preferred embodiment of the portable insulated case according to the invention is generally illustrated at 11. Portable insulated case 11 defines an insulated enclosure volume, generally designated at 12. This volume is adequate to accommodate a plurality of food and/or drink items which are held within the closed case.

Case 11 includes a top panel 13, a bottom panel (not shown) and a sidewall panel 14. A typical sidewall panel, such as that illustrated, has four sides in a generally rectangular upstanding arrangement. Other configurations, arrangements or designs can be practiced in order to provide a desired container shaping and sizing. Whatever arrangement of panels is chosen, the insulated case should be water-tight and not leak.

It will be noted that the top panel 13 includes an opening 15 therethrough. The illustrated embodiment also shows a second opening 16. It will be appreciated that three or more openings could also be provided, depending upon the size of the top panel and the intended requirements or selected specifications of the portable insulated case.

Each panel of the portable insulated case 11 has insulative properties in that heat transfer is retarded across the panel. An example of a suitable panel construction in this regard includes an internal core of foam 17. Suitable foam polymers include ethylpropylene ethylene (EPE). A typical core will be about 8 mm thick. External or on opposite sides thereof are a protective and decorative layer of polymer sheeting 18 and another protective and decorative layer of polymer sheeting 19. Layers 18 and 19 preferably are made of a material which is easy to clean. A suitable material in this regard is nylon sheeting. It will be appreciated that other materials and combinations of materials can be suitable.

In order to maintain the soft-sided characteristic of the portable insulated case, it is preferred that at least the sidewall panel 14 is pliable. In a typical case, the top panel 13 and/or the bottom panel also will be pliable. When provided, the soft-walled nature of the panels renders them more comfortable to handle, more easily fit into tight spaces when required, and generally lighter in weight.

Whatever the exact structure of the portable insulated case, a closure member or assembly, such as the illustrated zipper 21, is positioned with respect to the top panel 13 and the sidewall panel 14 such that the top panel is openable. Other closure members or assemblies are possible, such as snaps, hook-and-loop arrangements, string ties, and the like. The exact location of the selected closure member can vary, provided it allows for selective opening and closing of all or a large portion of the top panel, either alone or together with an upper portion of the sidewall panel. It is typically preferred that at least a portion of the top panel can remain attached to the rest of the portable insulated case. For example, in the embodiment illustrated in FIG. 3, the top panel remains attached to the sidewall along a hinge or edge area 22 (FIG. 3).

Figure 3:
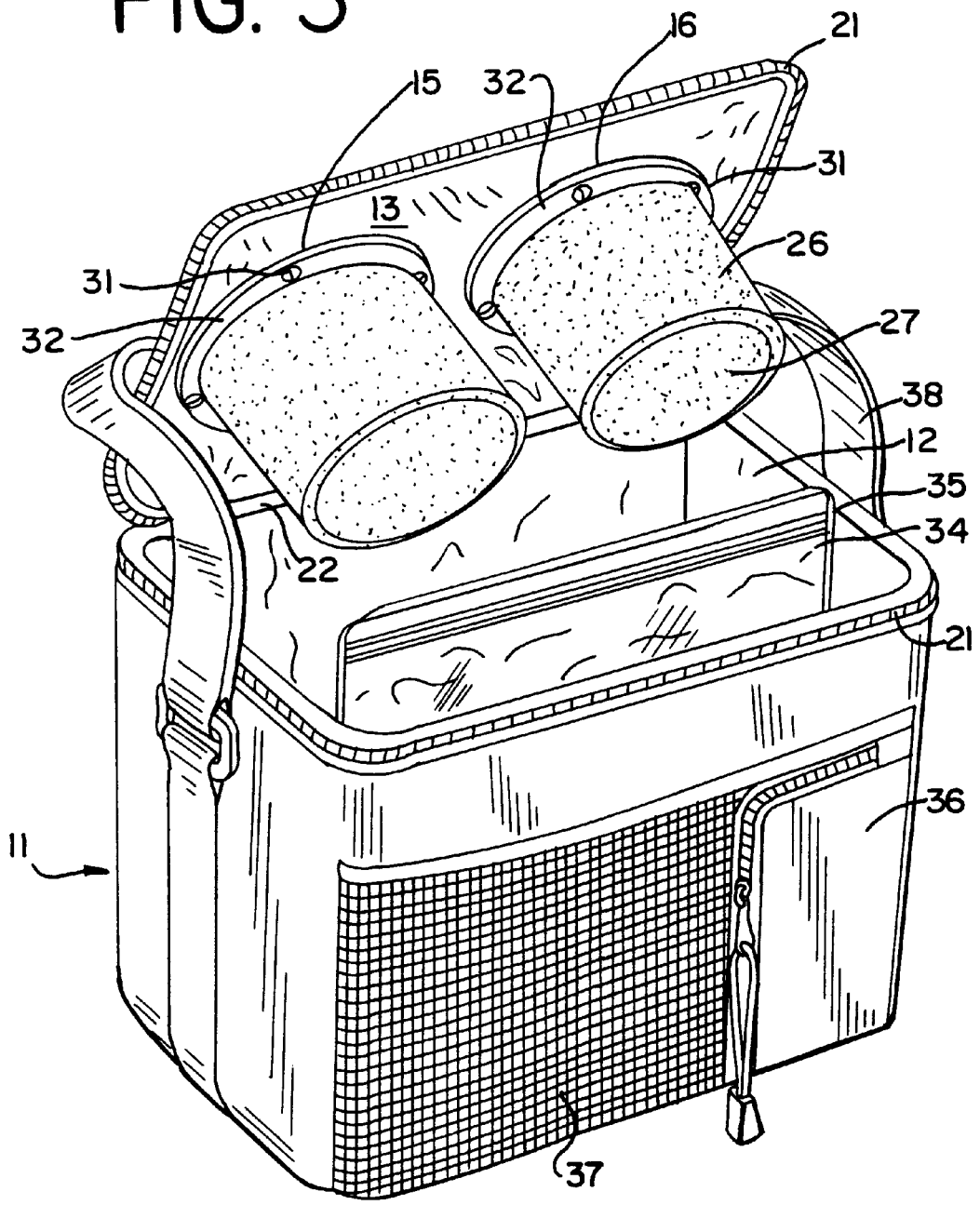
FIG. 3 is a perspective view of the embodiment as generally shown in FIG. 1, with the portable insulated case being shown in an open configuration.

It will be appreciated that, when the portable insulated case 11 is in the open configuration illustrated in FIG. 3, the user has ready access to the insulated enclosure volume 12, thereby allowing items such as filled drink cans 23 and filled drink bottles (glass or plastic) 24 to be placed within and removed from the insulated enclosure volume. In an important aspect of the invention, one or more selected cans 23, bottles 24 or the like can be accessed without having to undo the closure member, open the top, and thereby permit undesirable heat transfer through the resulting open area, whether the transfer be into the insulated case (when it is a cooler) or out of the insulated case (when it functions to keep warm items warm).

Figure 1:
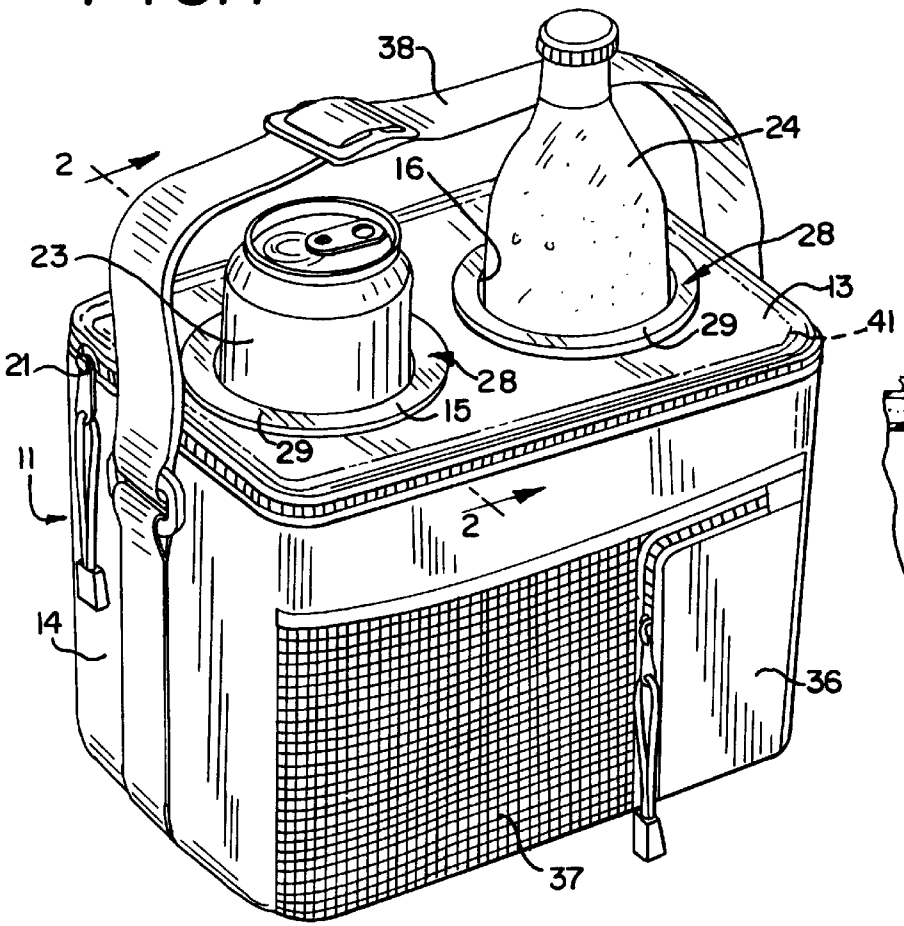
FIG. 1 is a perspective view of a preferred form of the portable insulated case according to the invention.

In accomplishing this objective, at least one externally accessible receptacle is provided. Two such receptacles are illustrated in FIG. 1 and in FIG. 3. In essence, each receptacle is in general alignment with opening 15, 16 in the top panel 13. Each externally accessible receptacle takes a general form desired for the particular end use. These include sleeves, pockets, shaped cylinders and the like. Each such receptacle includes a mouth 25. In the illustrated embodiment, mouth 25 conforms to the shape of the opening 15 and has a perimeter size slightly less than that of the opening 15. Mouth 25 is selected to have a perimeter and size which closely approximates the external perimeter shape and size of the can, bottle or the like to be held. The receptacle provides a downwardly depending structure which accommodates at least a substantial portion of the volume of the can, bottle or the like. Preferably, the height of the receptacle is less than the total height of the can, bottle or the like in order to permit easy digital access to the can, bottle or the like; that is, a user can grasp and easily remove the can, bottle or the like from out of the receptacle when desired, such as in order to drink from or pour from the can, bottle or the like.

The structure of the receptacle which is illustrated in the drawings includes a downwardly depending sidewall 26 which is generally vertically oriented when the portable insulated case is in the upright position as illustrated in the drawings. The illustrated receptacle further includes a bottom wall 27 upon which the can, bottle or the like can rest. In the illustrated form, downwardly depending sidewall 26 has the configuration of right cylinder, and the bottom wall 27 takes on the shape of a disc. This shaping is particularly well-suited for closely accommodating illustrated can 23 and/or bottle 24.

Preferably, the inner diameter of the downwardly depending sidewall 26 approximates that of a typical can 23 and/or bottle 24. It is especially preferred that at least the downwardly depending sidewall 26 is made of a pliable and somewhat resilient material. In that instance, the inside diameter of the sidewall 26 can be slightly greater than the outside diameter of the container 23, 24 so that the container will slightly compress the sidewall so as to enhance the gripping security imparted by the receptacle onto the container. A material found to be suitable in this regard is poly(2-chloro-1,3-butadiene), also known as polychloroprene or neoprene. Other synthetic rubber materials or pliable and resilient polymers can be used, for example. For convenience, the bottom wall 27 can be made of the same material as the downwardly depending sidewall 26. Preferably, the material of the receptacle is a waterproof material.

The receptacle is to be integral with the top panel 13 at its opening 15, 16. Single-piece construction is possible in this regard, although often an assembly can be somewhat more convenient, particularly when the receptacle material is different from that of the top panel 13. As an example, a flange member 28 can be used to join the receptacle to the top panel. Illustrated flange member 28 includes a horizontal plate 29 which overlies the opening 15, 16 and the adjacent edge of the top panel 13. A plurality of fastening devices such as the illustrated flexing fasteners 31 project from the horizontal plate 29 and into and through the top panel 13. Another horizontal plate 32 can also be included in order to enhance the security of the connection between the fastening devices and the top panel. In this regard, the fastening devices pass through respective openings provided in the separate horizontal plate 32. The illustrated flexing fasteners 31 snap into place thereat.

Illustrated flange member 28 also includes a vertical plate 33 which downwardly depends from the horizontal plate 29. A cut-out or indent 34 can be provided in the receptacle sidewall 26 in order to accommodate the thickness and height of the vertical plate 33. Alternatively, any inherent flexibility of the receptacle material can permit compression of that material which is under the vertical plate 33. By either approach, as illustrated, the exposed surface of the vertical plate is flush with the inside surface of the receptacle sidewall, or the vertical plate is slightly indented with respect to the receptacle. It will be appreciated that the surface of the receptacle typically will thus engage the container 23, 24 when same is present within the receptacle.

Typically, the insulated enclosure 12 of the case will also contain a cooling source which is a temperature below room temperature and which is typically below the freezing point of water. Ice or commercially available freezing packs are suitable. FIG. 3 illustrates the use of a heavy duty pouch having easy openable and closeable means, such as mating profile strips 35. Refrigerator ice or the like can be inserted into the pouch in order to contain, for example, ice as it melts into water.

It will be noted that the receptacles downwardly depend into the insulated enclosure 12 and thus (when the insulated case is a cooler) within the cool environment of the insulated enclosure which is caused by items within the enclosure. Such items include the cooling member which is typically included therewithin, for example the illustrated heavy duty pouch 34 containing ice cubes or the like. Also often contributing to this cool environment within the insulated enclosure 12 are the drink or food items enclosed therewithin. Because the receptacles are within this environment, they can be positively affected by the environment of the insulated enclosure.

More specifically, depending upon the material out of which the receptacles are made, for example the material of the downwardly depending sidewall 26 and bottom wall 27, a certain degree of heat transfer can occur across the walls of the receptacle. When this feature is provided, a can of soda, for example, which is well below room temperature when within the insulated enclosure 12 will still be subjected to the cooling environment of the insulated enclosure even after same is outside of the insulated enclosure volume and is placed within one of the receptacles, as seen in FIG. 1 and FIG. 2. When this feature is provided, the walls of the receptacle, such as the illustrated downwardly depending sidewall 26 and/or the bottom wall 27, allow a greater degree of heat transfer through them than is allowed by the panels of the portable insulated case 11. It will be appreciated that, under this circumstance, the rate of thermal transfer through the receptacle walls will be faster than through the case panels.

When a can, bottle or the like is positioned within a receptacle, such as is illustrated in FIG. 1 and FIG. 2, there occurs a reduction of heat transfer out of the can, bottle or the like and into the surrounding atmosphere which is typically at a temperature higher than that of the can, bottle or the like. Maintaining a cool item cool also is achieved in part because a substantial portion of the can, bottle or the like is shaded from the sun or other heat generating sources by virtue of its being enclosed within the receptacle. In addition, the receptacle itself has an insulative effect on the portion of the can, bottle or the like which is enclosed within the receptacle. Such insulating effects occur irrespective of any cooling effect imparted through the receptacle wall by virtue of the cool environment of the insulated enclosure 12.

All of the features described above provide a beneficial effect. Each contributes to the advantage of the invention of assisting in keeping the can, bottle or the like cool while same is securely held within one of the receptacles according to the invention. Overall, therefore, the invention provides advantageous security in preventing spillage of an open drink, for example, while simultaneously assisting in keeping the drink cool for a longer period of time than is achieved by approaches which do not combine a holding function with a cooling function within the same compact, convenient and portable device.

The illustrated portable insulated case includes a zippered security pocket 36 which is provided for convenient storage of smaller items such as keys, money, wallets, watches, personal items and the like. It will be appreciated that the illustrated zipper can be substituted for by using other closure arrangements. Also illustrated is an outside mesh pocket 37, which can be suitable for storing other items such as glasses, books, lotions and the like. The bottom panel (not shown) of the portable insulated case 11 is preferably made of a non-skid, durable and water-resistant material, or has an outer layer composed of material having these types of properties. An adjustable carrying strap 38 can be included as shown.

While the illustrations of the invention which are specifically shown herein indicate a fully open mouth 25 for each of the receptacles, it will be appreciated that temporary covers or closures can be included. For example, when it is desired to allow for closure of each receptacle mouth 25 when a can or the like is not within the receptacle, a sheet of material (or other structure) can be positioned for temporary full closure or partial closure of one (or of each) receptacle mouth. A top cover panel 41 is shown in phantom in FIG. 1 and in FIG. 2. A panel of this type can be provided. This allows the user to cover each receptacle mouth until it is desired to use the receptacle for holding and maintaining coolness (or warmness) of the can, bottle or the like by positioning same into the receptacle. Such a top cover panel can be temporarily secured to the outside of the insulated case by any suitable connection means, such as zipper, hook-and-loop components, snaps, tabs, tie strings and the like (not shown).

A total of two receptacles are shown in FIG. 1 and FIG. 3. Other possible variations provide a single receptacle, which would be particularly suitable for use by a single person. Larger portable insulated cases can include a greater number of receptacles in order to thereby accommodate a greater number of users. Correspondingly, the portable insulated case itself typically is larger in volume when there are a greater number of receptacles. In an illustrated arrangement, a single-receptacle portable insulated case will accommodate from four to six 12-ounce cans, a dual receptacle portable insulated case will accommodate about twelve such cans, and a triple-receptacle portable insulated case will accommodate twenty-four such cans.

It will be understood that the embodiments of the present invention which have been described are illustrative of some of the applications of the principles of the present invention. Various modifications may be made by those skilled in the art without departing from the true spirit and scope of the invention.

I claim:

1. A portable insulated case, comprising:

a portable soft-sided container having a top panel, a bottom panel and a sidewall panel joining said top panel and said bottom panel to define an insulated enclosure, said top panel having at least one opening therethrough, at least said sidewall panel being pliable;

a heat insulation component associated with each of said top panel, bottom panel and sidewall panel, said heat insulation component retarding transmission of heat through the portable soft-sided container;

a closure member which is selectively openable and closable, said closure member being positioned with respect to said top panel and said sidewall panel such that, when said closure member is opened, at least a portion of said top panel at least partially detaches from the remainder of the portable soft-sided container in order to permit access to said insulated enclosure;

at least one receptacle within and downwardly depending from said top panel, said receptacle having a mouth in general alignment with said opening in said top panel, said receptacle being generally closed in a downwardly depending orientation, said mouth and downwardly depending receptacle being sized and shaped in order to closely accommodate a containerized drink and the like; and said downwardly depending receptacle has a height such that at least a portion of the receptacle enters into said insulated enclosure, said height accommodating a substantial portion of the containerized drink and the like while still permitting easy digital access to the containerized drink and the like from outside of the portable insulated case.

2. The portable insulated case according to claim 1, wherein said receptacle includes a closed bottom and a downwardly depending sidewall between said closed bottom and the mouth of the receptacle.

3. The portable insulated case in accordance with claim 2, wherein said downwardly depending sidewall is substantially right cylindrical, and said closed bottom is substantially disc-shaped.

4. The portable insulated case in accordance with claim 1, wherein said receptacle is adapted to receive a containerized drink having a given transverse outside diameter, and said receptacle is generally cylindrical in shape and has an inside diameter which generally approximates the outside diameter of the containerized drink.

5. The portable insulated case in accordance with claim 1, wherein the receptacle has a resilient inside wall having an inside diameter which is less than the outside diameter of the containerized drink and the like, whereby the receptacle imparts a holding force on the containerized drink and the like.

6. The portable insulated case in accordance with claim 1, wherein said receptacle has a heat transfer property such that the temperature of the containerized drink and the like is retarded from rising due to the influence of the insulated enclosure when same is at a temperature lower than that of the containerized drink and the like.

7. The portable insulated case in accordance with claim 1, wherein the insulated enclosure includes means for imparting a temperature to the insulated enclosure which is less than that of room temperature.

8. The portable insulated case in accordance with claim 7, wherein the means for providing a reduced temperature includes a pouch containing ice cubes and the like.

9. The portable insulated case in accordance with claim 2, further including a flange member which secures an upper portion of said receptacle sidewall to said top panel at said opening therein.

10. The portable insulated case in accordance with claim 9, wherein said flange member includes a fastener which secures the flange member to the portable container.

11. The portable insulated case in accordance with claim 1, wherein said receptacle is sized and shaped to receive therewithin at least about one half of the containerized drink and the like.

12. The portable insulated case in accordance with claim 1, wherein said top panel and said bottom panel of the portable soft-sided container are pliable.

13. The portable insulated case in accordance with claim 1, wherein said mouth of the receptacle is open.

14. The portable insulated case in accordance with claim 1, further including a member which closes said mouth of the receptacle and which is movable in order to permit entry of a containerized drink or the like through the mouth and into the receptacle.

15. A portable insulated case for containerized drinks, comprising:

a portable soft-sided case having a top panel, a bottom panel and a multi-sided pliable sidewall panel joining said top panel and said bottom panel to define an insulated enclosure, said top panel having an opening therethrough;

each of said top, bottom and sidewall panels having at least one heat insulation layer, said heat insulation layer retarding transmission of heat through the portable soft-sided case;

closure means for selectively opening and closing at least a portion of said top panel in order to gain access to the insulated enclosure;

means for imparting a temperature to the insulated enclosure which is less than that of room temperature;

at least one receptacle within and downwardly depending from said top panel, said receptacle having a mouth in general alignment with said opening in the top panel, said receptacle having a bottom and a downwardly depending sidewall therebetween, said mouth and downwardly depending receptacle sidewall being sized and shaped in order to engage a containerized drink which the receptacle is adapted to accommodate, said receptacle being sized and shaped to receive at least about one half of the containerized drink and the like; and said bottom and downwardly depending sidewall of the receptacle define a height of said receptacle which enters into said insulated enclosure, said height being such that at least about one half of the containerized drink is within the insulated enclosure.

16. The insulated case in accordance with claim 15, wherein said receptacle is adapted to receive a containerized drink having a given transverse outside diameter, and said receptacle is generally cylindrical in shape and has an inside diameter which generally approximates the outside diameter of the containerized drink.

17. The insulated case in accordance with claim 15, wherein the receptacle has a resilient inside wall having an inside diameter which is less than the outside diameter of the containerized drink, whereby the receptacle imparts a holding force on the containerized drink.

18. The insulated case in accordance with claim 15, wherein said receptacle has a heat transfer property such that the temperature of the containerized drink is retarded from rising due to the influence of the insulated enclosure when same is at a temperature lower than that of the containerized drink.

19. The insulated case in accordance with claim 15, further including a flange member which secures an upper portion of said receptacle sidewall to said top panel at said opening therein.

20. The insulated case in accordance with claim 15, wherein said mouth of the receptacle is open.

21. The insulated case in accordance with claim 15, further including a member which closes said mouth of the receptacle and which is movable in order to permit entry of a containerized drink or the like through the mouth and into the receptacle.

22. A portable insulated case including at least one containerized drink, comprising:

a portable soft-sided case having a top panel, a bottom panel and a pliable sidewall panel joining said top panel and said bottom panel to define an insulated enclosure, said top panel having an opening therethrough;

each of said top, bottom and sidewall panels having at least one heat insulation layer, said heat insulation layer retarding transmission of heat through the portable soft-sided case;

closure means for selectively opening and closing at least a portion of said top panel in order to gain access to the insulated enclosure;

at least one containerized drink having a generally cylindrical cross-section;

at least one receptacle within and downwardly depending from said top panel, said receptacle having a mouth in general alignment with said opening in the top panel, said receptacle having a bottom and a downwardly depending sidewall therebetween, said mouth and downwardly depending receptacle sidewall being sized and shaped in order to engage said containerized drink, said receptacle being sized and shaped to receive a substantial portion of the containerized drink; and said bottom and downwardly depending sidewall of the receptacle define a height of said receptacle which enters into said insulated enclosure, said height being such that a substantial portion of the containerized drink is within the insulated enclosure.

23. The combination in accordance with claim 22, wherein said containerized drink has a given transverse outside diameter, and said receptacle is generally cylindrical in shape and has an inside diameter which generally approximates the outside diameter of the containerized drink.

24. The combination in accordance with claim 22, wherein the receptacle has a resilient inside wall having an inside diameter which is less than the outside diameter of the containerized drink, whereby the receptacle imparts a holding force on the containerized drink.

25. The combination in accordance with claim 22, wherein said receptacle has a heat transfer property such that the temperature of the containerized drink is retarded from rising due to the influence of the insulated enclosure when same is at a temperature lower than that of the containerized drink.

26. The combination in accordance with claim 22, further including a flange member which secures an upper portion of said receptacle sidewall to said top panel at said opening therein.

27. The combination in accordance with claim 22, wherein said mouth of the receptacle is open.

28. The combination in accordance with claim 22, further including a member which closes said mouth of the receptacle and which is movable in order to permit entry of said containerized drink through the mouth and into the receptacle.

* * * * *